US006086413A

United States Patent [19]

Karasik et al.

[11] Patent Number: 6,086,413

[45] Date of Patent: Jul. 11, 2000

[54] MULTIPLE WIRE CONNECTOR

[75] Inventors: Boris G. Karasik; Vladimir Karasik, both of Walled Lake, Mich.

[73] Assignee: Eaton Corporation, Cleveland, Ohio

[21] Appl. No.: 09/198,775

[22] Filed: Nov. 24, 1998

[51] Int. Cl.[7] ..... H01R 27/00

[52] U.S. Cl. ..... 439/516; 439/736; 439/860

[58] Field of Search ..... 439/516, 736, 439/860; 361/850, 900, 885, 882

[56] References Cited

U.S. PATENT DOCUMENTS

| | | | |
|---|---|---|---|
| 1,921,823 | 8/1933 | Hosking . | |
| 2,857,582 | 10/1958 | Wintriss . | |
| 3,742,432 | 6/1973 | Curtis et al. | 439/882 |
| 3,764,960 | 10/1973 | Heimbrock . | |
| 3,777,301 | 12/1973 | Michaels . | |
| 4,659,168 | 4/1987 | Collier . | |
| 4,872,262 | 10/1989 | Marach | 439/885 |
| 5,082,463 | 1/1992 | Saimoto . | |
| 5,529,509 | 6/1996 | Hayes . | |

*Primary Examiner*—Khiem Nguyen
*Assistant Examiner*—Son V. Nguyen
*Attorney, Agent, or Firm*—Roger A. Johnston

[57] ABSTRACT

A connector receptacle for simultaneously converting a plurality of individual wire leads in bayonet plug-in connection with a mating multiple pin wire harness connector. A conductive insert stamped from flat sheet stock has individual crimp-type wire lead terminals formed integrally therewith and extending outwardly from the margins of the insert. A plurality of barbed pin-receiving apertures are formed in the insert. Slots formed in the sheet stock form frangible webs interconnecting the material surrounding each of the barbed apertures. The insert is encapsulated with dielectric material preferably by molding and access openings in the dielectric material permit subsequent removal of the frangible webs to form individual electrically isolated connectors about each of barbed apertures. In one embodiment, individual wire leads are crimped onto each of the wire lead terminals after overmolding; and, in another embodiment the wire leads are crimped on before overmolding and the overmolding extends over the wire lead terminals to provide insulation and strain relief.

4 Claims, 4 Drawing Sheets

MULTIPLE WIRE CONNECTOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to connectors of the type employed for simultaneously connecting multiple conductors to a plug or receptacle and particularly such connectors of the type employed in the wiring harness of a motor vehicle.

Heretofore, it has been known to provide for simultaneous electrical connection to a plurality of electrical leads by plug-in connection of a plural pin connector into a receptacle having a plurality of individual wire leads inserted therein and positioned to simultaneously frictionally engage the pins of the mating electrical connector. However, in this known type of connection, an example of which is that shown and described in U.S. Pat. No. 3,777,301, it is necessary to manually insert each of the individual wire leads with a connector attached to the end thereof into the receptacle block in order to facilitate the simultaneous mating connection with a multiple pin connector.

This known arrangement has the disadvantage of requiring manual dexterity and being time consuming and therefore relatively costly for high volume automotive assembly operations.

Thus, it has long been desired to find a way or means of inexpensively manufacturing and installing electrical connectors of the multiple lead multiple pin type for simultaneous connection at assembly with the device being electrically wired.

One automotive application of the present invention is that of connecting the leads or terminals of individual servo-motors for automotive power seat adjustment to a receptacle connector for simultaneous mating electrical connection to a multiple pin wiring harness connector for connection to the user control switches.

BRIEF SUMMARY OF THE INVENTION

It is an object of the present invention to provide a relatively low cost, easy to manufacture, multiple lead electrical connector for mating bayonet-type connection with a multiple pin wiring harness connector.

The present invention utilizes an insert member stamped from a blank of electrically conductive sheet stock having a plurality of wire lead terminals formed integrally therewith and extending outwardly from the margins of the blank for crimping over individual electrical leads. The insert member has a plurality of barbed apertures therein for receiving mating connector pins; and, each of the apertures is surrounded by material interconnected to adjacent aperture surrounding material by frangible webs. The insert member is encapsulated in dielectric material, such as plastic, by molding with openings in the dielectric material providing access to the barbed apertures and enabling removal of the frangible interconnecting webs after molding to electrically isolate each of the wire terminal connectors with the material surrounding each aperture. In one embodiment of the present invention the wire leads are attached after the insert molding, and in another embodiment, the wire leads are attached prior to molding and the wire lead terminals are also encapsulated in dielectric material. The molded receptacle connector may then be simultaneously mated with a multiple pin electrical connector with the barbs in the apertures frictionally retaining each of the pins therein.

DETAILED DESCRIPTION OF THE INVENTION

Figure 1:
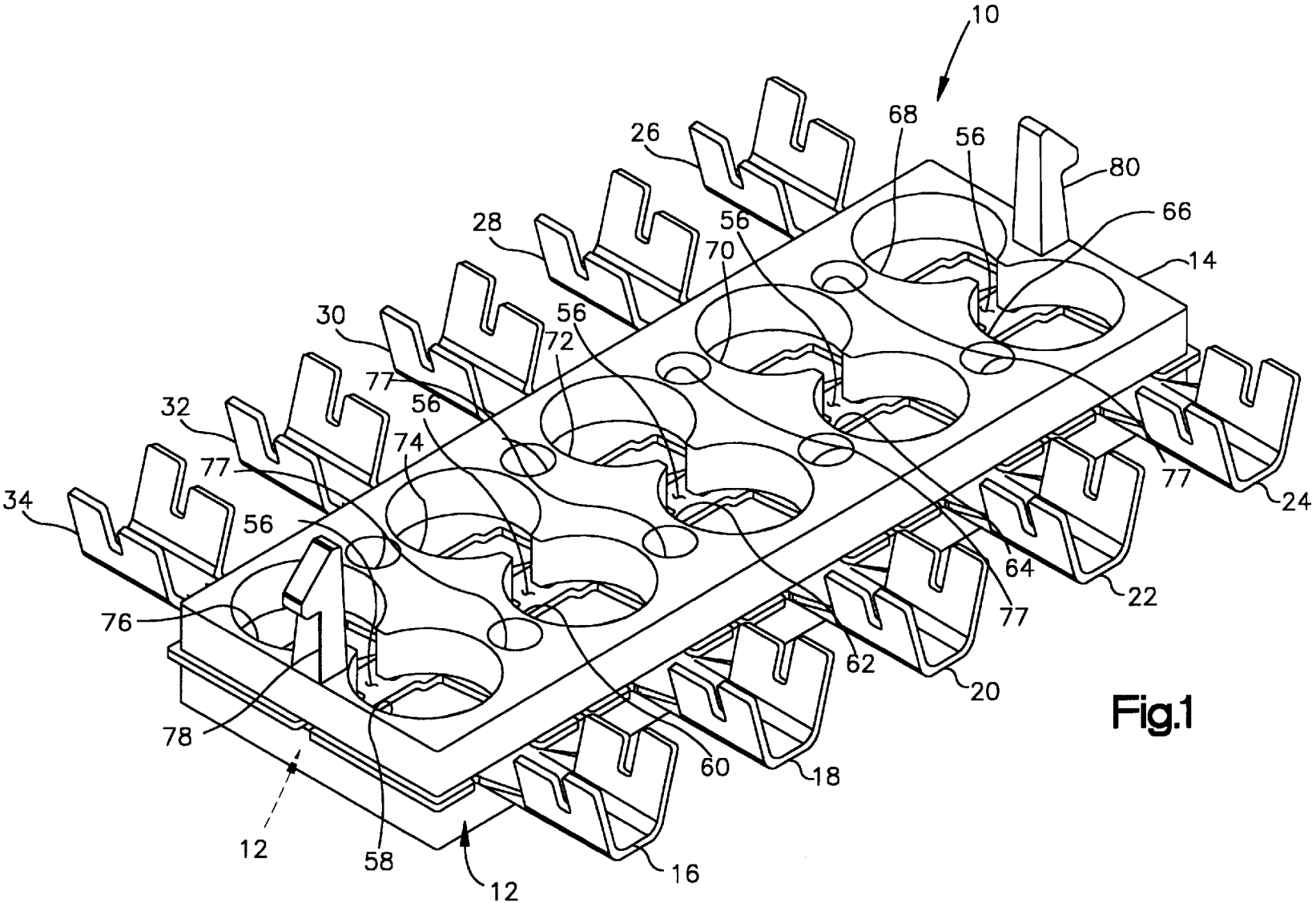
FIG. 1 is an axonometric view of the overmolded connector of the present invention.
Figure 2:
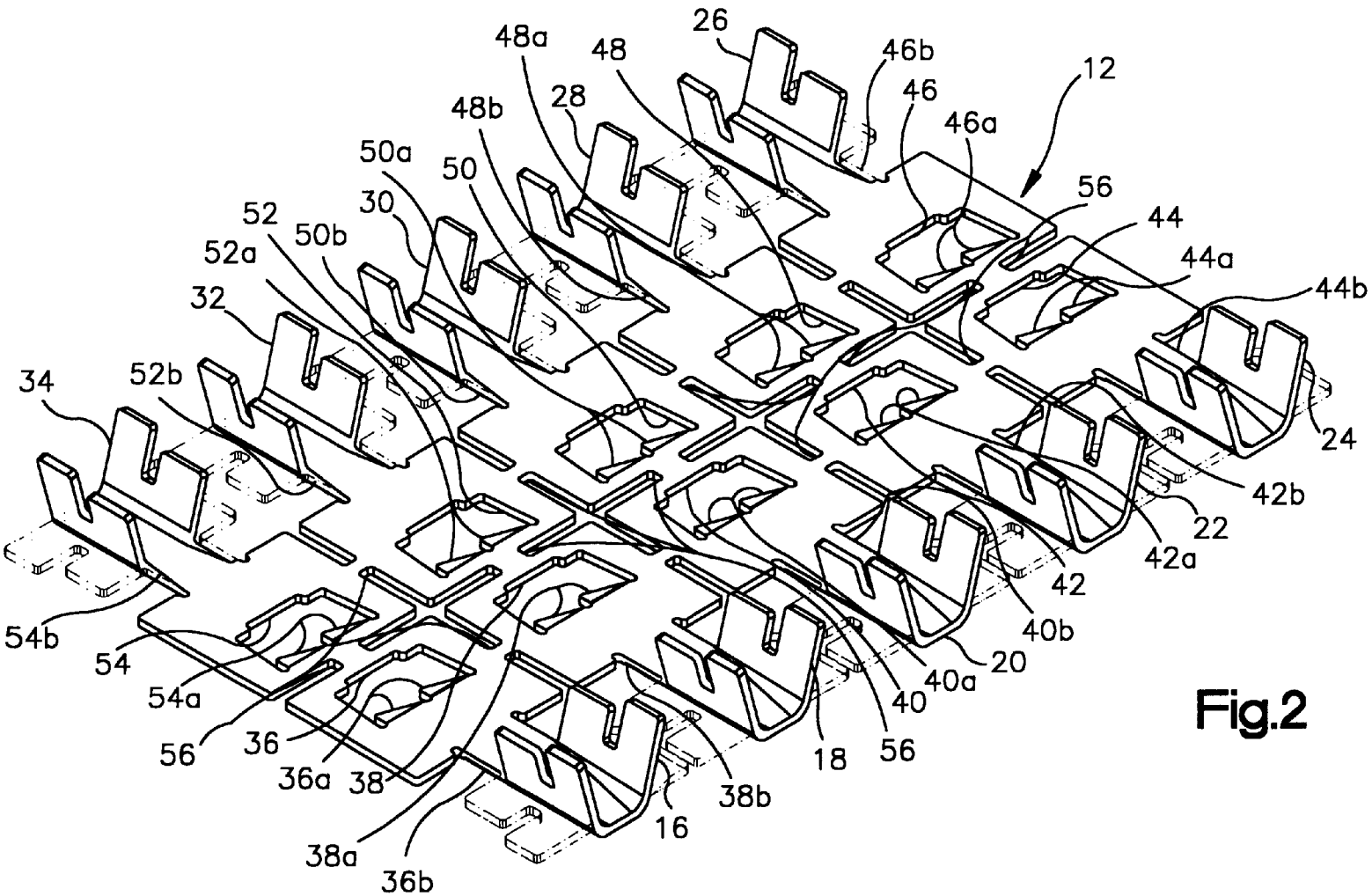
FIG. 2 is an axonometric view of the insert formed from a blank of conductive sheet stock for the connector of FIG. 1.

Referring to FIGS. 1 and 2, the connector assembly is indicated generally at 10 and includes an insert indicated generally at 12 and formed of conductive material and an overmold 14 formed of dielectric material.

Insert 12 is formed from a flat blank pattern which may be stamped from flat sheet stock in the configuration shown in dashed outline in FIG. 2. The insert 12 includes a plurality of individual wire lead terminals denoted by reference numerals 16 through 34 which are preferably of the crimped type having individual tabs for crimping respectively over the wire conductor and the insulation thereon. Such crimp-type terminals are well known in the art.

A plurality of apertures 36 through 54 are formed in the sheet material of insert member 12; and, each aperture is preferably provided with barbs denoted by the respective reference numeral with a suffix "*a*", i.e., 36*a*.

The material surrounding each of the apertures 36 through 54 is connected to the adjacent respective wire lead terminal 16 through 34 by a strip or neck portion bearing the reference numeral of the aperture with a suffix "*b*", i.e., 36*b*.

The material surrounding each of the apertures 36 through 54 is isolated from the adjacent aperture's surrounding material by a plurality of slots such that the material surrounding each aperture is connected to the material surrounding the adjacent aperture only by the interconnecting webs denoted by reference numeral 56.

Referring to FIG. 1, the member 12 of FIG. 2 is encapsulated, preferably by being inserted in a mold (not shown) and overmolding, with dielectric material to produce the overmold 14 which has a plurality of access openings denoted respectively by reference numerals 58 through 76, each of which is positioned respectively coincident with one of the apertures 36 through 54 in the insert member 12 to expose the corresponding aperture in the member 12. A plurality of smaller secondary access openings 77 is provided between each of the apertures 58 through 76 to provide access to the interconnecting strips 56; and, the strips 56 are then removed, as for example by punching through the apertures in the overmold, to electrically isolate each of the terminals 16 through 34 from the respective adjacent terminals. Overmold 14 is provided at each end thereof with a snap locking barbed tab denoted by reference numerals 78, 80 for securing attachment to an adjacent mating pinned connector (not shown in FIG. 1).

Figure 3:
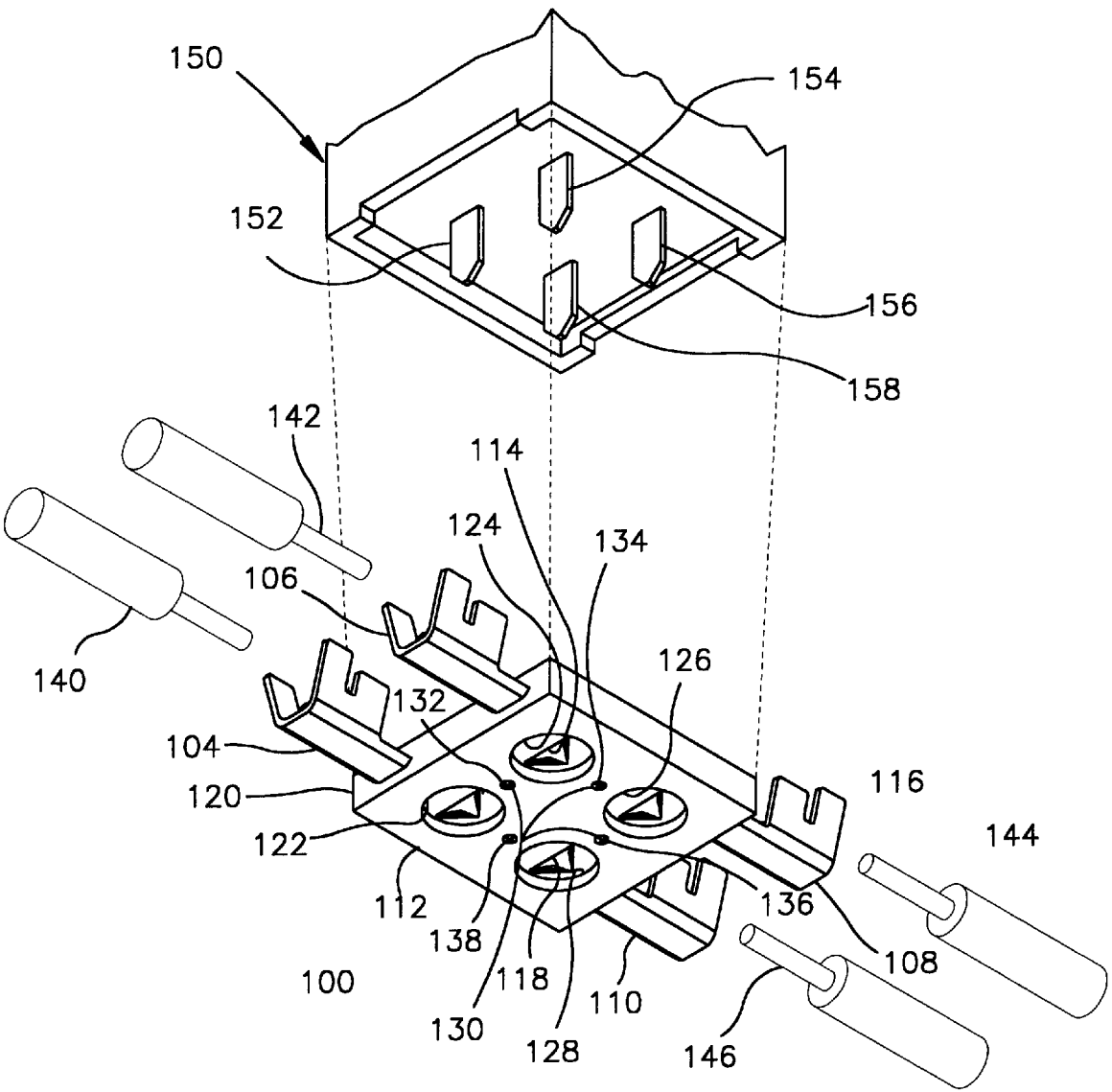
FIG. 3 is an exploded view of an alternate embodiment of the connector assembled to a mating multiple pin harness connector and individual electrical wire leads; and, FIG. 4 is another embodiment of the connector of FIG. 1.

Referring to FIG. 3, another embodiment of the invention is indicated generally at 100 and has an insert member 102 formed of sheet stock and having formed integrally therewith and extending outwardly therefrom a plurality of wire lead connecting terminals 104 through 110. The insert 102 has a plurality of preferably barbed apertures indicated respectively at 112 through 118 formed therein in spaced relationship and is encapsulated with an overmold 120 which has access openings indicated respectively 122 through 128 provided coincident with each of the barbed apertures 112 through 118 for permitting access thereto. Overmold 120 also has a plurality of auxiliary access openings 130 formed therein to permit access to removing interconnecting strips 132 through 138 provided in the insert 102. It will be understood that the removal of these strips 132 through 138 is performed in a manner identical to that of the embodiment of FIG. 1.

Each of the wire lead connecting terminals 104 through 110 has received therein an insulated wire lead denoted respectively 140 through 146, which is electrically connected thereto by crimping as is well known in the art.

A multiple pin electrical connector indicated generally at 150 is disposed adjacent connector 100 and has a plurality of pins or prongs 152 through 158, each of which engages respectively one of the barbed apertures 112 through 118 upon plug-in connection of the connector 150 to the receptacle connector 100.

Figure 4:
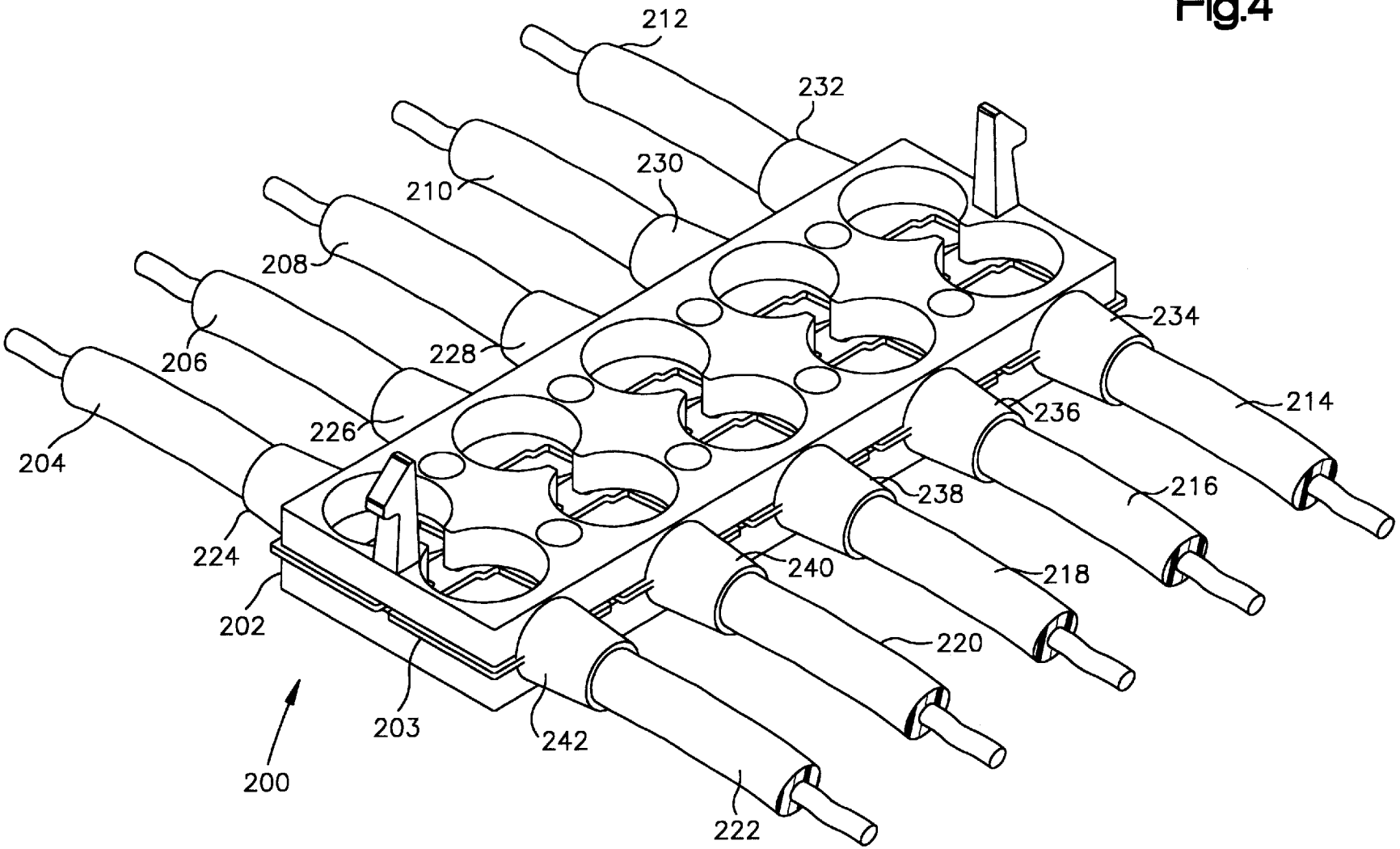

Referring to FIG. 4, another embodiment of the receptacle connector of FIG. 1 is indicated generally at 200 and has an insert 203 shown in dashed outline which may be identical to the insert 12 of FIG. 1 which has wire leads attached to the terminals thereof as denoted by reference numerals 204 through 222 prior to encapsulation with overmold 202. The overmold 202 has outwardly extending portions which encapsulate each of the wire terminals, as denoted by reference numerals 224 through 242 in FIG. 4, which portions serve to provide strain relief for the insert terminals and wire connections and to provide continuity of electrical insulation from the insulated leads to the overmold. It will be understood that with the exception of the outwardly extending strain relief/insulation portions 224 through 238, the receptacle connector 200 of FIG. 4 is otherwise identical to that of FIG. 1 insofar as the formation of the insert with barbed apertures and access openings in the overmold 202.

The present invention thus provides a simple and relatively low cost technique and method for providing simultaneous plug-in connection of a multiple pin wiring harness connector to a wiring connector receptacle which has a plurality of wire leads attachable thereto and extending outwardly therefrom. The receptacle connector of the present invention provides for frictional engagement and retention of the plug-in connection.

Although the invention has hereinabove been described with respect to the illustrated embodiments, it will be understood that the invention is capable of modification and variation and is limited only by the following claims.

What is claimed is:

1. An electrical connector for connection to a multiple pin connector comprising:

(a) a sheet of conductive material having a plurality of wire lead connecting terminals formed integrally therewith and extending outwardly therefrom, wherein said sheet has a plurality of first apertures formed therein;

(b) dielectric material molded over said sheet and having a plurality of second apertures therein each coinciding with one of said first apertures, wherein said lead connecting terminals are electrically isolated by removing material from said sheet through said second aperture; and, (c) a wire lead connected to each of said lead connecting terminals, wherein each of said first apertures includes surfaces operable upon insertion of an external connector pin therein, to frictionally engage and retain said pin.

2. The connector defined in claim 1, wherein each of said wire lead connecting terminals has the material thereof crimped over one of said wire leads.

3. The connector defined in claim 1, wherein said dielectric material comprises plastic material.

4. The connector defined in claim 1, wherein each of said first apertures has barbed portions provided on the edges thereof.

* * * * *